US008062127B2

(12) United States Patent
Filipour et al.

(10) Patent No.: US 8,062,127 B2
(45) Date of Patent: Nov. 22, 2011

(54) METHODS AND SYSTEMS FOR INTELLIGENT DISPUTE RESOLUTION WITHIN NEXT GENERATION CASINO GAMES

(75) Inventors: Cameron Anthony Filipour, Las Vegas, NV (US); Thierry Brunet de Courssou, Missilac (FR); Alexander Popovich, Henderson, NV (US); Adam Singer, Las Vegas, NV (US)

(73) Assignee: IGT, Reno, NV (US)

( * ) Notice: Subject to any disclaimer, the term of this patent is extended or adjusted under 35 U.S.C. 154(b) by 210 days.

(21) Appl. No.: 12/497,806

(22) Filed: Jul. 6, 2009

(65) Prior Publication Data

US 2010/0004060 A1 Jan. 7, 2010

Related U.S. Application Data

(60) Provisional application No. 61/078,419, filed on Jul. 6, 2008.

(51) Int. Cl.
*A63F 9/24* (2006.01)

(52) U.S. Cl. ..... 463/30; 463/38; 463/25

(58) Field of Classification Search ..... 463/30, 463/38, 25

See application file for complete search history.

(56) References Cited

U.S. PATENT DOCUMENTS

| | | | | |
|---|---|---|---|---|
| 5,033,744 | A * | 7/1991 | Bridgeman et al. | 463/13 |
| 6,863,608 | B1 * | 3/2005 | LeMay et al. | 463/24 |
| 7,198,571 | B2 | 4/2007 | LeMay | |
| 7,331,520 | B2 | 2/2008 | Silva | |
| 7,347,778 | B2 | 3/2008 | Rothschild | |
| 7,384,339 | B2 | 6/2008 | LeMay | |
| 7,828,645 | B2 * | 11/2010 | Walker et al. | 463/25 |
| 2002/0173349 | A1 * | 11/2002 | Ach, III | 463/1 |
| 2003/0176218 | A1 | 9/2003 | LeMay et al. | |
| 2005/0064926 | A1 * | 3/2005 | Walker et al. | 463/16 |
| 2005/0125244 | A1 * | 6/2005 | Schneider | 705/1 |
| 2008/0076546 | A1 | 3/2008 | Moyle et al. | |
| 2008/0108405 | A1 | 5/2008 | Brosnan | |
| 2008/0234047 | A1 | 9/2008 | Nguyen | |
| 2009/0104954 | A1 | 4/2009 | Weber et al. | |

OTHER PUBLICATIONS

Gambling Equipment Fault/Player Dispute Report, downloaded from http://dia.govt.nz/Pubforms.nsf/URL/EMSFaultorDisputeReport.pdf/$file/EMSFaultorDisputeReport.sxlf on Jun. 20, 2009.

* cited by examiner

*Primary Examiner* — Dmitry Suhol
*Assistant Examiner* — Michael Grant
(74) *Attorney, Agent, or Firm* — Young Law Firm, P.C.

(57) ABSTRACT

A dispute resolution model for next generation action/skill casino games comprising a variety of friendly onscreen methods to demonstrate the fairness of a disputed game or simply to allow the player to eliminate confusion created by fast action wagering. Such methods may include running on-demand instant replays of segments of wagered games to allow both players and operators to verify those games' fairness and providing the player with historical information regarding the operation of the casino game and/or the gaming machine. The historical information includes historical win information to demonstrate the distribution of previous wins; Skill vs. luck historical information to demonstrate the exact role both luck and skill played in a player's game outcome; and peer comparison historical information to enable the player to compare the recent payback history of a given game to identical games on the casino floor, and to show the player which machines have been the luckiest over a given period of time.

44 Claims, 12 Drawing Sheets

METHODS AND SYSTEMS FOR INTELLIGENT DISPUTE RESOLUTION WITHIN NEXT GENERATION CASINO GAMES

BACKGROUND OF THE INVENTION

Embodiments of the present inventions relate generally to the field of regulated electronic games of chance.

SUMMARY OF THE INVENTION

The embodiments of the methods and systems for intelligent dispute resolution within next generation casino games disclosed herein facilitate the evolution of casino gaming by: 1) improving both the speed and quality of dispute resolution for common legacy game patron disputes; 2) anticipating new varieties of patron disputes that will arise when fully interactive, skill-based games grow prevalent on the casino floor; and 3) devising a multi-tiered method to resolve the anticipated disputes efficiently.

As casino games begin to measure a more complete player skill set that includes manual dexterity or other player skill sets, casino game operators will be forced to address a new variety of player disputes that focus on more complex player interactions. The most high profile electronic casino game disputes of the past have centered on non-payment of jackpots due to malfunction. Other, less publicized disputes occur when slot machine players and video poker players dispute the frequency of winning symbols or winning card combinations appearing within their games (i.e. the player questions a game's randomness or payback frequency). The next generation dispute resolution methods disclosed herein will better address these existing classes of game disputes. In addition, the disclosed Patron Dispute Resolution Model (referred to hereafter by the acronym PDRM) according to embodiments of the present inventions will address a more complicated brand of disputes that is likely to arise when players in the future dispute how onscreen game assets behave or respond to player input. Existing dispute resolution models (which involve referring a majority of dispute claims to local gaming control boards and handling a minority of dispute claims by generating slow in-house reports and investigations) will not likely be able to handle the complexity or volume of this new class of future dispute in a satisfactory manner.

A significant component of the disclosed PDRM, according to embodiments of the present inventions, is the ability for the patron or game operator to generate on-demand reports on the actual gaming machine on which the patron played and that is the subject of his or her complaint or concern. Such on-demand reports may answer the patron's questions and ultimately resolve his or her concerns. In addition, the reporting paradigm used to demonstrate that games are operating fairly must be reinvented. In the past, local gaming authorities have addressed payout frequency disputes by two varieties of simple reports.

The first such conventional report type displays a brief game history for a disputed game. Regulations vary from jurisdiction to jurisdiction, but many local gaming commissions require that a game store basic regulatory accounting information for its last 10 wagered games. Typically stored information includes the time of the player's bet, the player's bet size, the player's balance before the wager, the player's balance after the wager, whether there was a bonus achieved, whether there was a jackpot achieved, and the size of the player's win. Many machines also allow for graphical game recall of the few games stored in memory. In practice, these reports and graphical recalls are not regularly used to resolve patron disputes because they do not contain much data and because it is not particularly convenient for busy slot managers or technicians to run them. When the reports are used, it is often to discourage players from making false claims about a machine owing them a win.

The second conventional report type used to resolve patron disputes ensures that each game is returning a fair percentage of funds to the player (a concept referred to hereafter as "Return to Player" or RTP) statistically over time. If, for example, a game was legally required to return no less than 85% of funds input to players, and a patron launched a dispute of the fairness of that game, a report would be generated to establish the actual RTP of the disputed game. If the RTP was determined to be greater than or equal to 85%, then the game would be considered fair and the dispute would be dismissed. If, however, the RTP was determined to be less than 85%, then the game would be considered unfair and the owner of the dispute would be entitled to some monetary compensation (and, in some cases, the game operator would face fines or sanctions).

While fair, the existing model and report types do not resolve disputes in a manner that is especially clear or satisfactory to the player. While the vast majority of payout frequency disputes end up being dismissed, it would be advantageous to better explain the reasons for these dismissals to players and to educate players why a particular dispute lacked merit. The current system of dismissing the player's concerns by citing an RTP report that the player may not understand can be improved upon.

Players, unlike casino operators, do not typically think about a casino game in terms of its mathematical expectation (i.e. RTP); players are more likely to think about a game in terms of how frequently it outputs money. A video poker player who complains to a game operator that a particular machine has not dealt him any four-of-a-kind hands in two days is far more likely to be satisfied by a report showing how many four-of-a-kinds the machine has dealt out in the past day or week than he or she would be by a report showing that the machine's RTP for the current week is 88.7%. The legacy game history reports cannot satisfy this need because they do not store all of the useful data, are seldom used, and do not store data over a long enough timeframe.

The described fundamental disconnect in the way that players and operators think and talk about games makes legacy payout frequency dispute resolution models sub-optimal. The reports these models output are intended to ease player concerns but are couched in language understood mainly by the operator. While flawed, these models have not been improved for a variety of reasons, including: 1) the inefficiency of funneling a large percentage of disputes through a local gaming commission causes a lot of patrons to drop their claims rather than complete a lengthy claim submission process; 2) allowing a local gaming commission to handle most patron disputes reduces the casino operator's workload; 3) adding steps to the current process to better educate the player would increase the operator's workload; and 4) a satisfactory replacement model has not, to date, been available.

As gaming models become increasingly complicated and disputes become more common, the language used in dispute resolution reports will need to become clearer to the player or casino operators will run the risk of eroding the confidence of their player base. The embodiments of the PDRM disclosed herein will accomplish this aim by allowing operators to provide players with one or more of the following onscreen reports quickly and efficiently: 1) instant replays which may be captured for all games—not just the last ten—to demonstrate visually that past games involved no abnormal events, that the game responded to player input in a timely manner, that winning symbols were or were not achieved, etc.; 2) Historical Win reports to demonstrate that a gaming machine is and has been awarding wins to players; 3) Skill vs. Luck reports to demonstrate to players how much of their result in a given game was dictated by luck and how much was dictated by their relative skill level; and 4) Peer Comparison reports to demonstrate how a gaming machine's payouts compare to the payouts of similar games on the casino floor. Because these reports may be generated by the patron with either no or minimal operator intervention, the new features offered within this PDRM will not come at the expense of adding to the operator's workload in a significant manner.

Accordingly, an embodiment of the present inventions is a method that includes steps of providing a regulated gaming machine; providing a regulated game that is configured to run on the regulated gaming machine; enabling a player to play the regulated game on the provided regulated gaming machine; receiving, via a first player interaction with the regulated gaming machine, an indication that the player wishes to initiate a dispute in the regulated game, and responsive to the received indication of the initiated dispute, enabling the player to view a playback of at least a portion of the played regulated game, and selectively generating and providing the player with historical information regarding an operation of the regulated game and/or the regulated gaming machine.

According to further embodiments, the method may also include a step of receiving, via a second player interaction, an indication that the player's dispute remains unresolved. Responsive to the received second player indication, the method further may include a step of summoning live help to attempt to resolve the player's dispute. The playback and the historical information may be provided on display(s) of the regulated gaming machine. The historical information providing step may be carried out such that the historical information includes an indication of an amount of luck experienced by the player dining game play of the regulated game and/or an amount (or degree) of skill exhibited by the player during game play of the regulated game. The playback providing step may include a step of providing a visual indication of player input as the provided playback unfolds. The visual indication of player input may include joystick (or other controller/player input) movement and buttons pressed. The playback providing step may include a step of providing player controls configured to enable the player to pause, step, fast forward and/or rewind the playback. The playback providing step may be carried out by storing key events during game play and thereafter reconstructing game play using the stored key events. Alternatively, the playback providing step may be carried out by recording game play and playing back the recorded game play on demand. The playback providing step may include enabling the player to tag relevant moments during the playback.

The historical information providing step may be carried out with the historical information including information regarding an historical operation of the regulated game played on the regulated gaming machine, and/or a plurality of regulated games having been played on the regulated gaming machine. The historical information providing step may be carried out with the historical information providing how frequently wins have been achieved on the regulated gaming machine. The historical information providing step may be carried out with the historical information providing a payback frequency of the regulated gaming machine as compared to other regulated gaming machines playing the (e.g., same) regulated game. The playback and/or historical information providing step may be carried out such that the playback and historical information are provided to the player upon request (e.g., by the player or casino attendant). The historical information providing step may be carried out with the historical information providing an indication of the role that both luck and skill played in determining the outcome of the regulated game. The method may further include a step of recording and storing every game played over a selectable time interval. The method may also include a step of providing the player who has caused a dispute to be initiated the ability to cause the playback to be stored for later access and retrieval.

The method may also include a step of displaying a wizard on the regulated gaming machine, the wizard enabling the player to identify a nature of the initiated dispute and to select appropriate historical information to generate and provide to the player, in a step-by-step format. The historical information providing step may be carried out with the historical information including historical win information that provides a frequency with which different symbol combinations, hands or events (for example) have historically occurred on the regulated game and/or the regulated gaming machine.

The historical information providing step may be carried out with the historical information including historical win information that provides a number of games that have elapsed since a selected symbol combination, hand or event (for example) has occurred. The historical information providing step may be carried out with the historical information including peer comparison information that provides an indication of how lucky the regulated gaming machine has been, the indication of how lucky the regulated gaming machine has been being related to an actual Return-To-Player (RTP) of the regulated game (and/or other regulated games) on the regulated gaming machine (or other regulated gaming machines).

The historical information providing step may also be carried out with the historical information displaying how many games have been played since at least one of the regulated game and the regulated gaming machine has paid a jackpot (or some other predetermined payout or prize). The historical information providing step may be carried out with the historical information including luck and skill information that provides the player with an indication of a manner in which the outcome of the regulated game was influenced by randomness and by a measured skill of the player.

Another embodiment of the present inventions is a regulated gaming machine. Such a regulated gaming machine may include (or have access to) a regulated game configured to run on the regulated gaming machine; one or more displays; a button configured to enable the player to initiate a dispute. The regulated gaming machine is configured to, responsive to the player pressing the button (mechanical, electro-mechanical or displayed on a touch screen, for example), or otherwise initiating a dispute, enabling the player to view a playback of at least a portion of the played regulated game, and selectively generating and providing the player with historical information regarding an operation of the regulated game and/or the regulated gaming machine.

The regulated gaming machine may be further configured to issue, upon receipt of input from the player, an indication that the player's dispute remains unresolved. The regulated gaming machine may further include a button (or other user interaction functionality) configured to summon live help to attempt to resolve the player's dispute.

The regulated gaming machine may be configured such that the historical information displayed on the display(s) includes an indication of an amount of luck (randomness)

experienced by the player during game play of the regulated game and/or an amount of skill exhibited by the player during game play of the regulated game. The regulated gaming machine may be configured such that the playback displayed on the display(s) provides a visual indication of player input as the provided playback unfolds. The visual indication of player input may include, for example, joystick movement, buttons pressed or other interaction with the regulated game's user interface. The playback providing step may include a step of providing player controls configured to enable the player to pause, step, fast forward and/or rewind the playback. The playback may be generated by storing key events during game play and thereafter reconstructing game play using the stored key events. The regulated gaming machine may also be configured such that the playback is generated by recording game play and thereafter playing back the recorded game play. The regulated gaming machine may be configured to enable the player to tag relevant moments during the playback.

The regulated gaming machine may be configured such that the historical information includes information regarding an historical operation of the regulated game played on the regulated gaming machine and/or a plurality of regulated games having been played on the regulated gaming machine. The regulated gaming machine may be configured such that the historical information displayed on the display(s) provides (e.g., shows) how frequently wins have been achieved on the regulated gaming machine. The regulated gaming machine may be configured such that the historical information displayed on the display(s) includes information regarding a payback frequency of the regulated gaming machine as compared to other regulated gaming machines playing the (e.g., same) regulated game.

The regulated gaming machine may be configured such that the historical information and/or playback displayed on the display(s) are provided to the player upon request (e.g., by the player, casino attendant or someone else). The regulated gaming machine may be configured such that the historical information displayed on the display(s) provides an indication of a role that both luck (i.e., randomness) and the player's measured skill played in determining an outcome of the regulated game. The regulated gaming machine may be configured to record and store every game played over a selectable time interval (e.g., last 24 hours, last week, etc.). The regulated gaming machine may be configured to enable the player who has caused a dispute to be initiated to cause the playback to be stored for later access and retrieval.

The regulated gaming machine may further include (a software module that generates) a wizard displayed on the at least one display, the wizard being configured to enable the player to identify the nature of the initiated dispute and to select an appropriate playback and/or appropriate historical information to generate and provide to the player, in a step-by-step format. The regulated gaming machine may be configured such that the historical information includes historical win information that provides a frequency with which different symbol combinations, hands or events (for example) have historically occurred on the (and/or other) regulated gaming machine. The regulated gaming machine may be configured such that the historical information includes historical win information that provides a number of games that have elapsed since a selected symbol combination, hand or event has occurred. The regulated gaming machine may be configured such that the historical information includes peer comparison information that provides an indication of how lucky the regulated gaming machine has been, the indication of how "lucky" (from the player's pint of view) the regulated gaming machine has been being related to an actual (i.e., measured) Return-To-Player (RTP) of the regulated game (and/or other regulated games) on the regulated gaming machine (and/or other regulated gaming machines). The regulated gaming machine may be configured such that the historical information includes (e.g., provides, displays) how many games have been played since the regulated game and/or the regulated gaming machine has paid a jackpot or some other selected predetermined prize. The regulated gaming machine is configured such that the historical information includes luck and skill information that provides the player with an indication of a manner in which the outcome of the regulated game was influenced by randomness and by the measured skill of the player.

BRIEF DESCRIPTION OF THE DRAWINGS

Prior art

DETAILED DESCRIPTION

In the following detailed description of exemplary embodiments of the invention, reference is made to the accompanying drawings, which form a part hereof, and in which is shown by way of illustration specific exemplary embodiments in which the invention may be practiced. These embodiments are described in sufficient detail to enable those skilled in the art to practice the invention, and it is to be understood that other embodiments may be utilized and that logical, mechanical, electrical and other changes may be made without departing from the spirit or scope of the present invention. The following detailed description is, therefore, not to be taken in a limiting sense, and the scope of the present invention is defined only by the appended claims.

Figure 1:
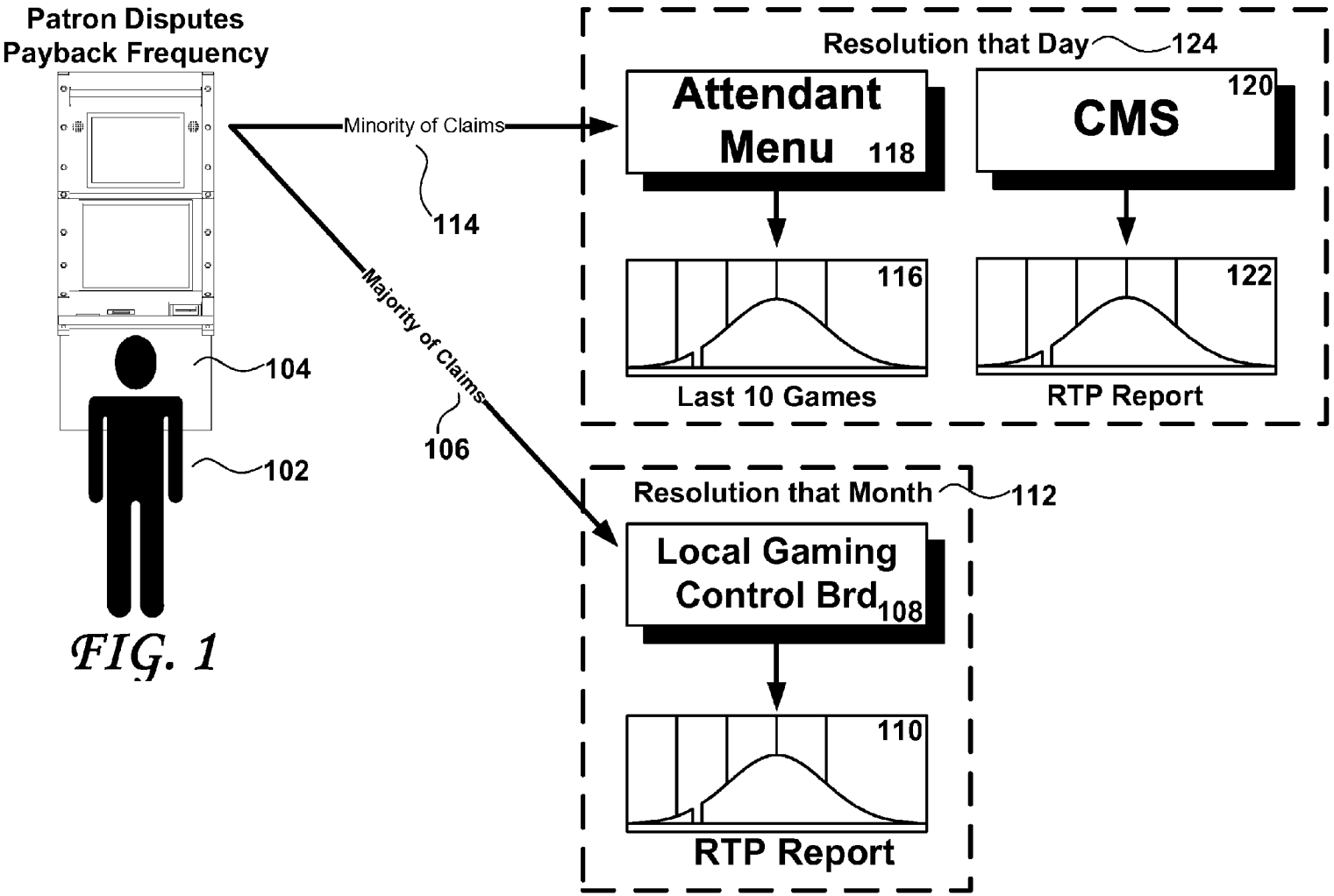
FIG. 1 depicts the legacy patron dispute resolution model for disputes of payback frequency.

Prior art FIG. 1 depicts the legacy patron dispute resolution model for disputes of payback frequency. In this model, when a player 102 disputes the fairness of a gaming machine 104 he has been playing, he is typically referred to the local gaming control board in the jurisdiction in which he is playing, as suggested at 106. The rules in this process differ from jurisdiction to jurisdiction but generally, for disputes involving more than $500.00, the casino is legally obligated to contact the local gaming control board. For disputes involving smaller sums of money, the casino is typically legally obligated to inform the player of his or her right to file a claim with the local gaming control board, but is not obligated to contact the gaming board themselves.

Casinos often consider payback frequency disputes to be a nuisance. Indeed, because their business relies on keeping very close tabs on the payback percentages of each machine on their gaming floor, casino operators know that their games, except in extremely rare cases, are fair. Given this assurance, casinos are often happy to refer this variety of dispute to the local gaming control board so as not to waste valuable man-hours. A further advantage of this stance, from the casino's perspective, is that only a small percentage of players who have been referred to the local gaming board actually go through the time and effort of following a claim. When a patron does file a claim with a gaming control board 108, then that organization will investigate the situation as shown at 110, usually by gathering data to confirm the RTP of the gaming machine in question. In many jurisdictions, the gaming board is legally obligated to complete their investigation within thirty days of the patron filing a claim, meaning this process, in a worst case scenario, takes a month, as shown at 112.

In some cases, the casino operator will attempt to address a patron's concern in-house, as shown at 114. In instances in which the player is falsely claiming a win, the slot manager or attendant may pull data on the last 10 games as shown at 116 from the machine's attendant menu 118 to display that no win was in fact earned. In other instances, the slot manager may pull data from the Casino Management System ("CMS") 120 to investigate the RTP of the game in question. An RTP report 122 can be generated to prove that the game is paying out a percentage of funds input by the player that is both expected and within that gaming jurisdiction's legal range. While such an in-house investigation is resolved considerably faster (typically, one day, as shown at 124) than a claim filed with the local gaming control board, it is rarely resolved instantaneously since data is usually gathered in the back of the house. In some cases, data generated during an in-house investigation will be submitted to the local gaming control board for use in an investigation generated by that organization.

Figure 2:
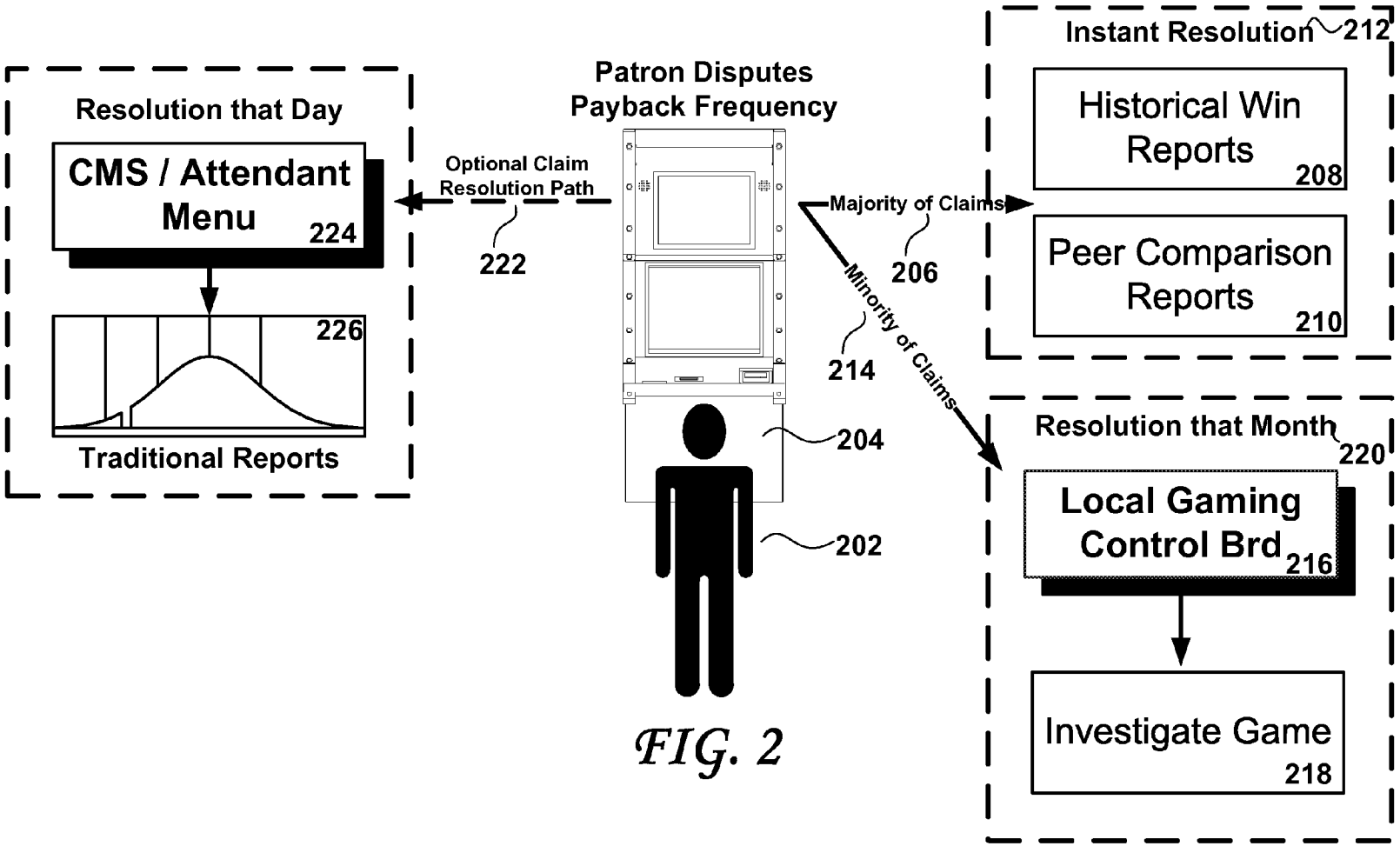
FIG. 2 depicts a payback frequency dispute resolution model for next generation casino games, according to embodiments of the present invention.

FIG. 2 depicts a payback frequency dispute resolution model for next generation casino games, according to embodiments of the present invention. In the disclosed PDRM, when players 202 dispute the fairness of a gaming machine 204, the majority of such claims, as shown at 206, may be handled instantaneously by, for example, generating a report on a display of the gaming machine 204, as shown at 206. The player may view a variety of reports in these cases including, for example, a Historical Win Report 208 which demonstrates how frequently wins have been achieved on the gaming machine in question and/or a Peer Comparison Report 210 which charts a gaming machine's payback frequency relative to identical games on the casino floor (note that with the advent of the server-based gaming paradigm in which multiple gaming titles may be played on multiple gaming machines, a "game" may be defined as a specific gaming software title running on a specific gaming machine). Casino operators may elect to allow players to generate these dispute resolution reports themselves or they may be generated when slot technicians or slot managers input a special code or key or card into the gaming machine. In any case, the reports may be generated instantaneously or near instantaneously. Because these reports focus on simplified concepts couched in the player's language (i.e. how often did the machine issue a particular winning symbol combination or how "lucky" is a given machine relative to its peers), they are likely to satisfy most payback frequency disputes quickly and efficiently.

Players who are not satisfied by the reports detailed above will still have the option of filing a dispute with their local gaming commission, as suggested at 214. In that case, the process may work just as it did in the legacy model, with the gaming control board 216 investigating the situation, generating an investigation into the game's payback frequency 218, and providing a ruling to the player within 30 days, as shown at 220. The gaming control board may use data and dispute resolution reports generated by the casino to aid in their investigation.

Similarly, the casino operator would also retain the ability to satisfy the patron's concerns 222 by using data contained within the Attendant Menus or Casino Management System ("CMS") 224 to view the traditional reports 226 as were used in legacy dispute resolution models.

Figure 3:
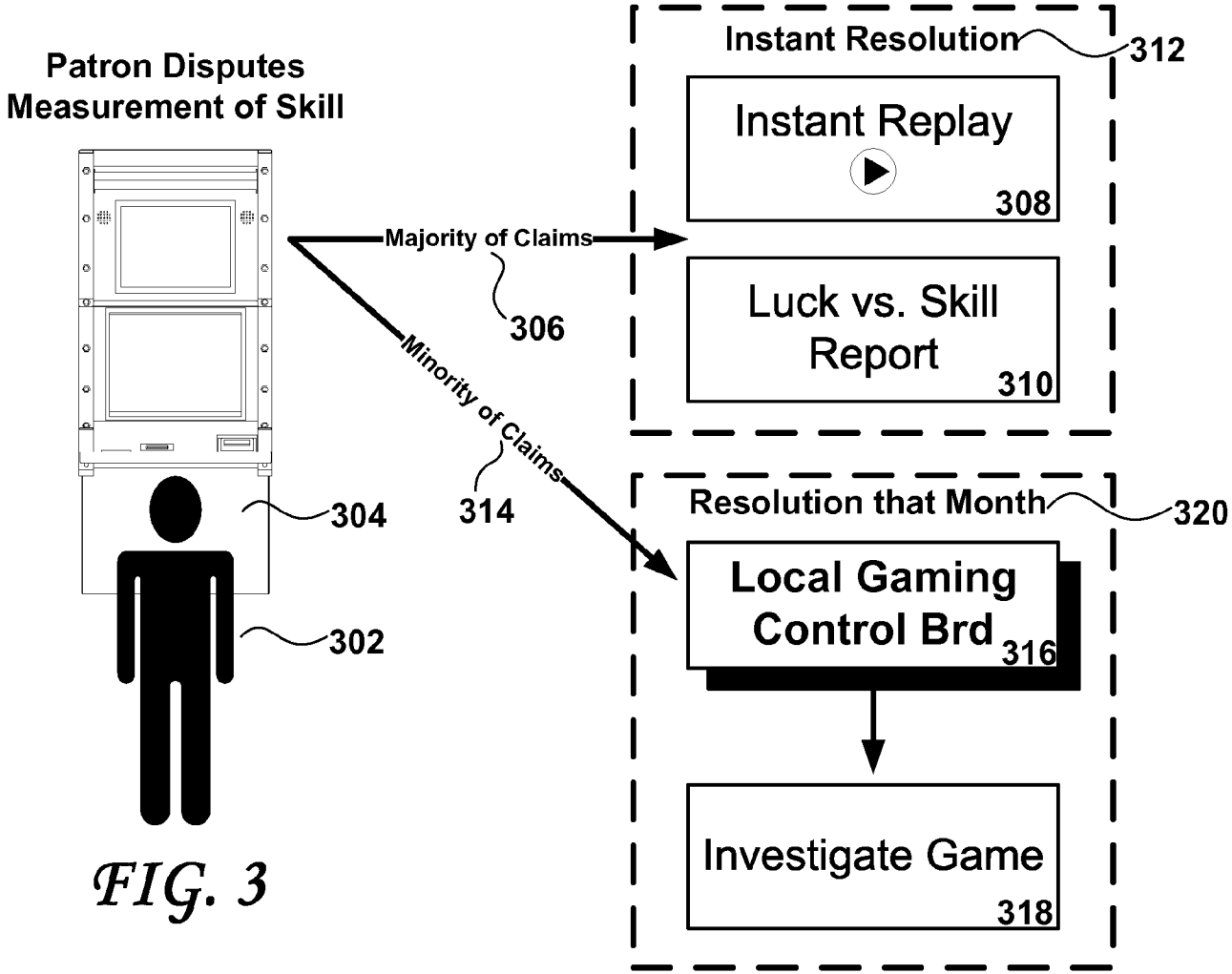
FIG. 3 depicts a player skill measurement dispute resolution model for next generation casino games, according to embodiments of the present invention.

FIG. 3 depicts a player skill measurement dispute resolution model for next generation casino games according to embodiments of the present invention. In the disclosed PDRM, when a player 302 disputes the way his skill (or other player-related criterion) has been measured or assessed on a gaming machine 304 he has been playing, most of the time as suggested by 306, his dispute may be handled instantaneously or nearly instantaneously, by showing the player an instant replay or report generated on the gaming screen in front of him.

In the disclosed PDRM, replays 308 may be stored for all games played on the gaming machine and a button may be provided that allows the player to tag problematic segments of their games on the gaming machine and then view them later in a convenient format. For console style games, a feature may be added to display the player's input into the game (i.e. joystick movement, buttons pressed) as a replay of the game unfolds. This feature would allow the player to track his or her input into the game with a visual display of the correlation between that input and the way it affected the game unfolding onscreen. A full explanation of how instant replays may be used for dispute resolution is given hereunder with reference to FIG. 10.

Luck vs. Skill reports 310 demonstrate to players the exact role both luck and skill (and/or other player criterion) played in determining their game outcome. These reports will help players understand their results in greater detail, thus reducing disputes caused by ignorance of the gaming process. A full explanation of how Luck vs. Skill reports may be used for dispute resolution is given hereunder with reference to FIG. 11. One key advantage of both instant replays and Luck vs. Skill reports is that they may be generated instantaneously or nearly instantaneously (or, in event quickly; that is, during or just after the player's gaming session or game), as suggested by reference numeral 312. According to further embodiments, such reports may be generated well after the player's game or gaming session.

Players who are not satisfied by instant replays or on-demand reports will still have the option of filing a dispute with their local gaming commission, as shown at 314. In this case, the process will work just as it did in the legacy model, with the gaming control board 316 investigating the situation, analyzing data on the game's payback frequency 318, and providing a ruling to the player within 30 days as shown at 320. Because current gaming models do not include instant replays or Skill vs. Luck Reports, the disclosed PDRM may provide valuable input into the local gaming control board's future investigations.

Figure 4:
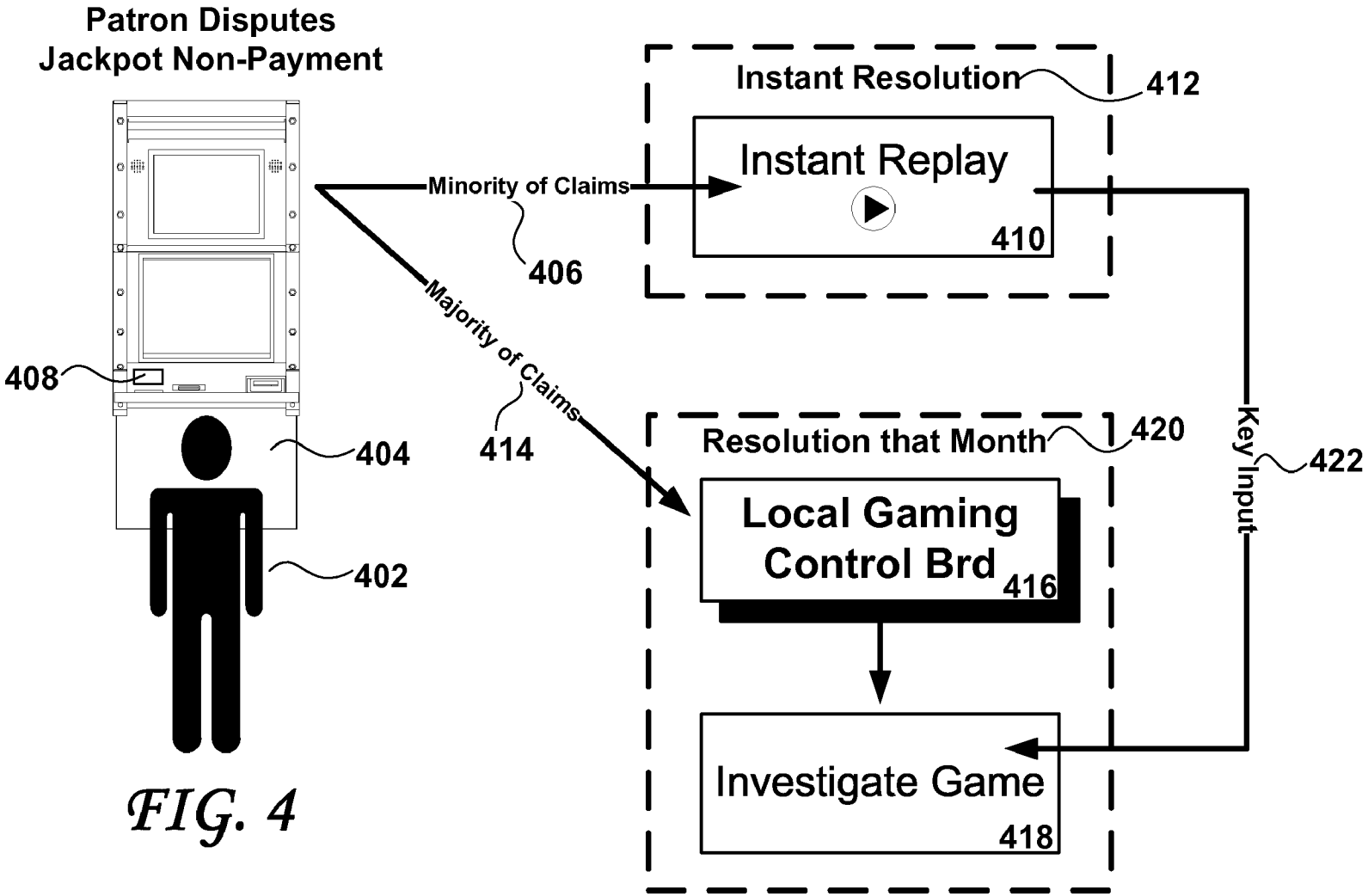
FIG. 4 depicts a jackpot non-payment dispute resolution model for next generation casino games, according to embodiments of the present invention.

FIG. 4 depicts a jackpot non-payment dispute resolution model for next generation casino games according to embodiments of the present invention. Jackpot non-payment disputes are easily the highest profile disputes faced by casino operators of the current era. In the past, a number of casinos have endured considerable negative publicity when patrons who claimed to have won a jackpot that was not honored also claimed that slot technicians opened machines and tampered with them before local gaming control board members could launch an investigation. In many of these incidents, the only relevant forensic evidence that either the casino or the patron was able to draw upon was the casino's surveillance video. More and more machines now are equipped with graphical replays which should protect the player's rights; however, many of these replays are only stored for a small number of games and may, in some cases, be erased or overwritten by an unscrupulous operator or attendant. A significant feature of the embodiments of PDRM is full game playback, a feature in which every game—not just the last 10—is stored for later analysis (games may be eventually erased, but not on a timetable shorter than 24 hours) so that the player is protected against key data being overwritten.

According to embodiments of the PDRM, when a player 402 feels that a gaming machine 404 has not paid out a jackpot to which the player believes that he or she is entitled, the player may launch a preliminary investigation him or herself, as shown at 406. To do so, the player may activate an onscreen command labeled "DISPUTE" or "STORE REPLAY" or "INVESTIGATE GAME" 408 or any other of a number of possible labeling schemes which causes the gaming machine to tag a previous segment of play in the game's memory for convenient retrieval later (patrons will then have the ability to view the tagged replay 410 and be provided with the ability to rewind, fast-forward, pause, watch the game in slow motion and the like, with familiar video playback controls). In cases in which the gaming operator wants to exert tighter control, the patron may be able to press an onscreen "STORE REPLAY" button to tag the disputed segment of video and alert a slot technician or slot manager to come investigate the situation by viewing the instant replay themselves 410 or, for operators who want even tighter control, the replay in question may be stored and only accessed by the local gaming commission. In any of these cases, the casino and player now have improved forensic evidence relative to conventional dispute resolution methods and are able to resolve most issues on a considerably faster timetable than previous methods have afforded, as suggested at 412. Within the present context, the term "instant" and "instantaneous" may be replaced with "rapid," "quick," "near-instantaneous" or other similar term intended to convey a speedy resolution of the dispute, most often during or just after the player's gaming session or game.

Because this type of dispute typically involves large sums of money, the majority of these claims, as suggested at 414, will be referred to the local gaming control board 416. However, some potential claims that were made in error may be dismissed by the patron him or herself after viewing the game replay. The local gaming control board will investigate those claims that the patron wishes to pursue 418 within the legally defined time limits for that jurisdiction, usually 30 days, as suggested at 420. The gaming control board's investigation, now with the benefit of protected game instant replays 422, will likely lead to more accurate rulings than previous evidence collection methods have made possible.

Figure 5:
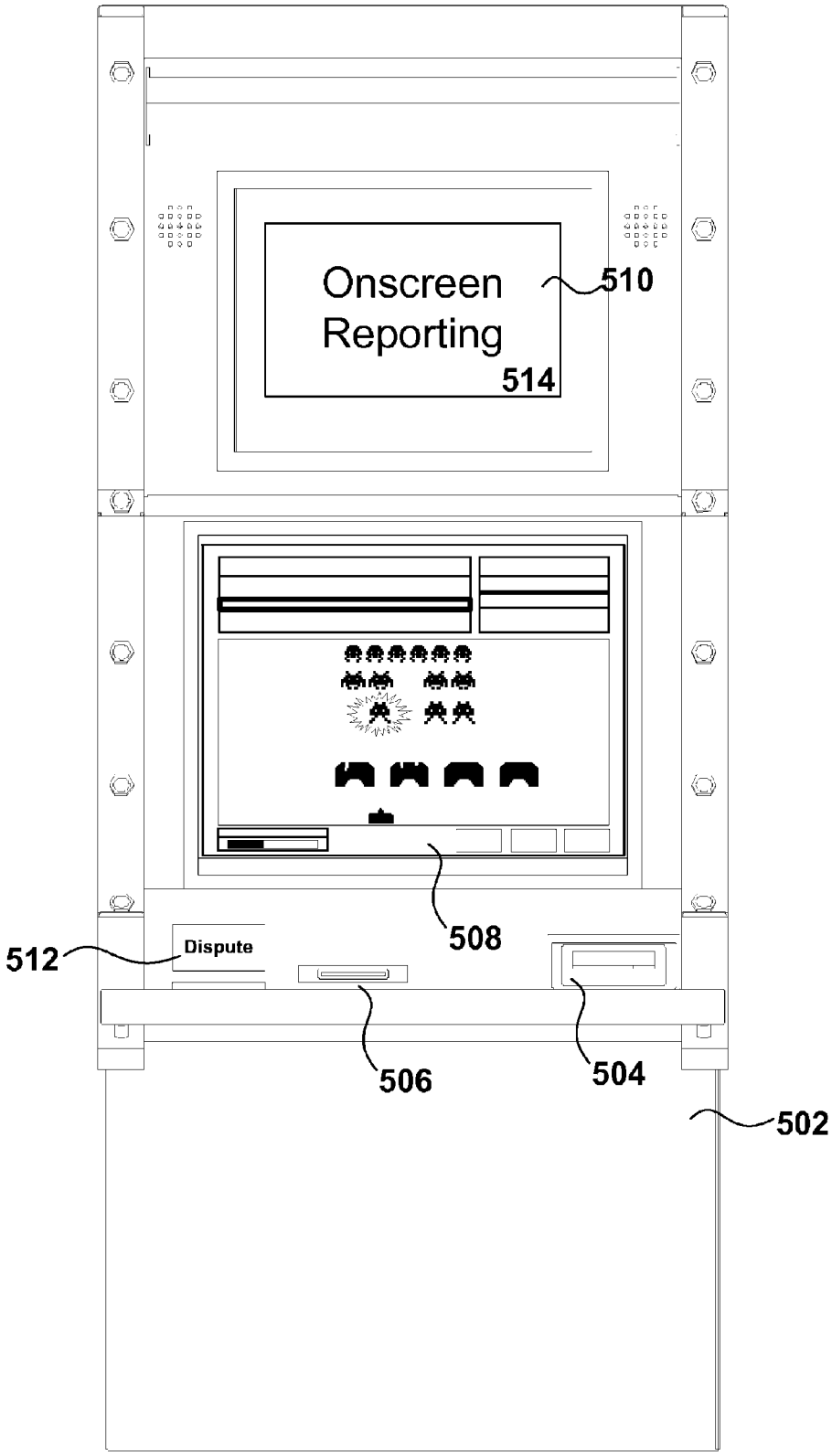
FIG. 5 demonstrates how patron disputes may be addressed via onscreen reporting, according to embodiments of the present invention.

FIG. 5 demonstrates how patron disputes may be addressed via onscreen reporting, according to embodiments of the present invention. Existing gaming machines of the prior art 502 featuring conventional peripherals such as bill acceptors 504, ticket printers 506, primary gaming screens 508 and secondary gaming screens 510 and may be configured, according to embodiments of the present invention, to enable the present next generation patron dispute model. In some embodiments of the inventions disclosed herein, one or more "DISPUTE" or "STORE REPLAY" or "INVESTIGATE GAME" buttons 512 (either hardware or by software, via a touchscreen, for example) maybe be added to the gaming machine to allow the patron to initiate self-service dispute resolution.

The gaming machine in FIG. 5 illustrates that an onscreen report 514 may be displayed on the gaming machine's top or secondary gaming screen 510. In some cases onscreen reports may assume the popular "wizard" format, allowing patrons to view relevant reports or replays and resolve their own disputes in a step-by-step format. In these cases, touchscreen interactivity may be preferred, causing the reports to be displayed on the gaming machine's primary screen 508. Some dispute resolution reports may make use of both gaming screens concurrently or successively.

Figure 6:
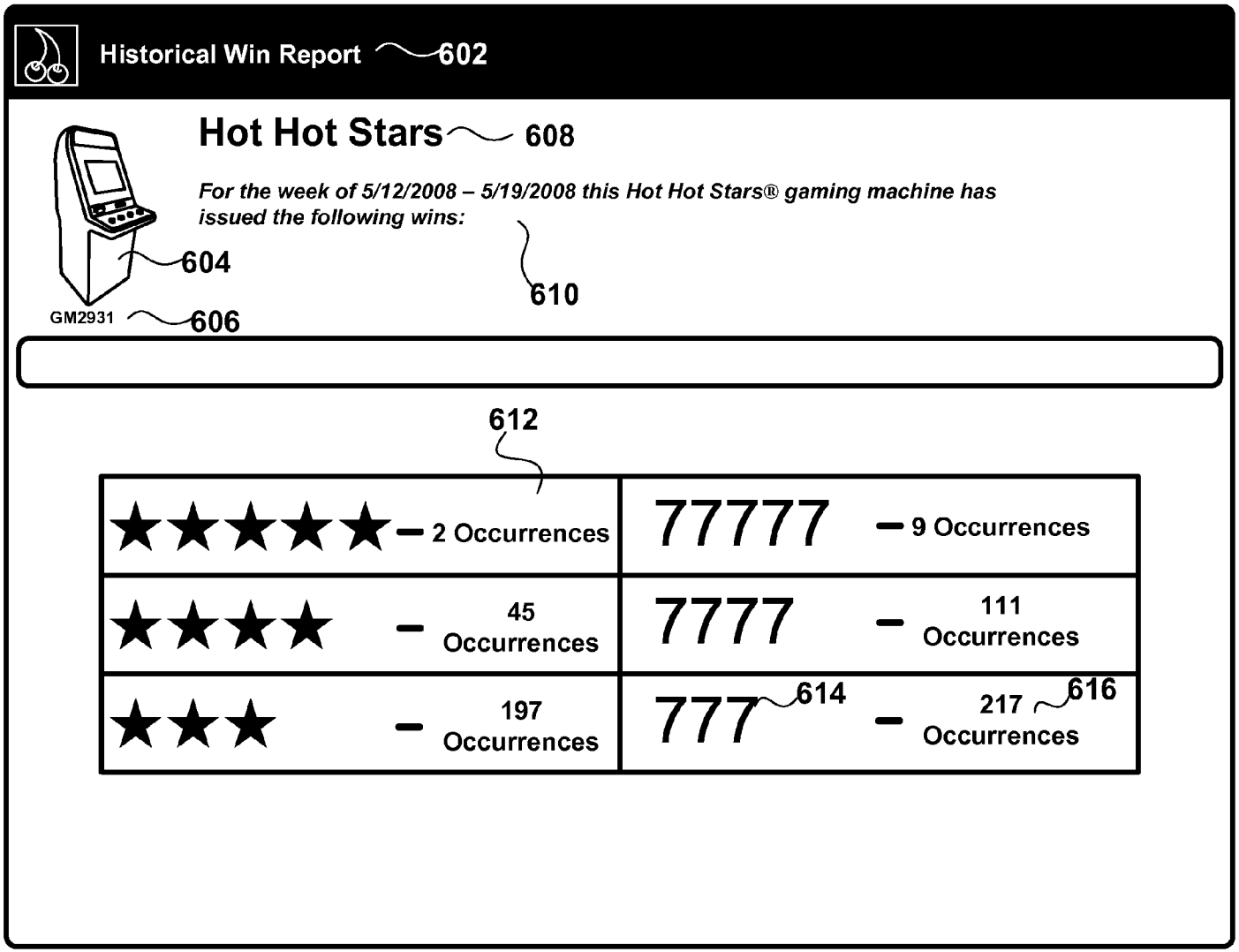
FIG. 6 depicts one possible Historical Win Report format which displays the frequency of symbol combinations occurring, according to embodiments of the present invention.

FIG. 6 depicts one possible Historical Win Report format which displays the frequency of symbol combinations occurring, according to embodiments of the present invention. When evaluating the fairness or attractiveness of a game, the typical players—particularly slot machine players—are more likely to prefer a report detailing how many wins that game has paid out, rather than a report of the game's measured RTP. The Historical Win Report 602 is designed to calm the player's anxieties or superstitions and ease his concerns by demonstrating, in simple terms, that the machine is issuing wins. FIG. 6 depicts one possible format for this report, although numerous formats are possible.

The depicted report features a representation of the gaming machine 604 being disputed, as well as a unique identifier 606 for that machine, which unique identifier may be useful for later identification. The disputed game's title 608, in this case "Hot Hot Stars," may be depicted as well as some text explaining the purpose of the report, the time range covered by the report, and any other information 610 that the operator deems relevant.

The principal value of the report is a table demonstrating how many specific win types the machine has paid out over a given time period 612. The depicted table shows, for example, that the winning symbol combination of "777" 614 has, as shown at 616, been achieved 217 times on the Hot Hot Stars game over the week of May 12, 2008-May 17, 2008, the time range shown at 610. Depending on how casino operators wish to configure their games, players may have the ability to alter the time range of the report and look at how machines have paid out, for example, in the last hour, day, week, month or year (or any player selectable time range). Given the advent of server-based gaming models in which multiple gaming titles may be played on multiple gaming machines, casino operators may configure the machines to display payouts by gaming title (i.e. show results for players playing Hot Hot Stars on any gaming machine in the casino) or by distinct combination of gaming title and gaming machine (i.e. show results for players playing Hot Hot Stars on the specific gaming machine on which the report was generated).

It should also be noted that while the depicted gaming machine shows symbol payouts for a slot machine game, Historical Win Reports could be configured to display the prevalence of specific hands being dealt in a video poker game, of specific levels or milestones being reached in a next generation casino (e.g., arcade or console-style) video game, of a specific number of trivia questions being answered correctly in a casino trivia game, of a specific number of puzzles being completed successfully in a casino puzzle game, etc.

Figure 7:
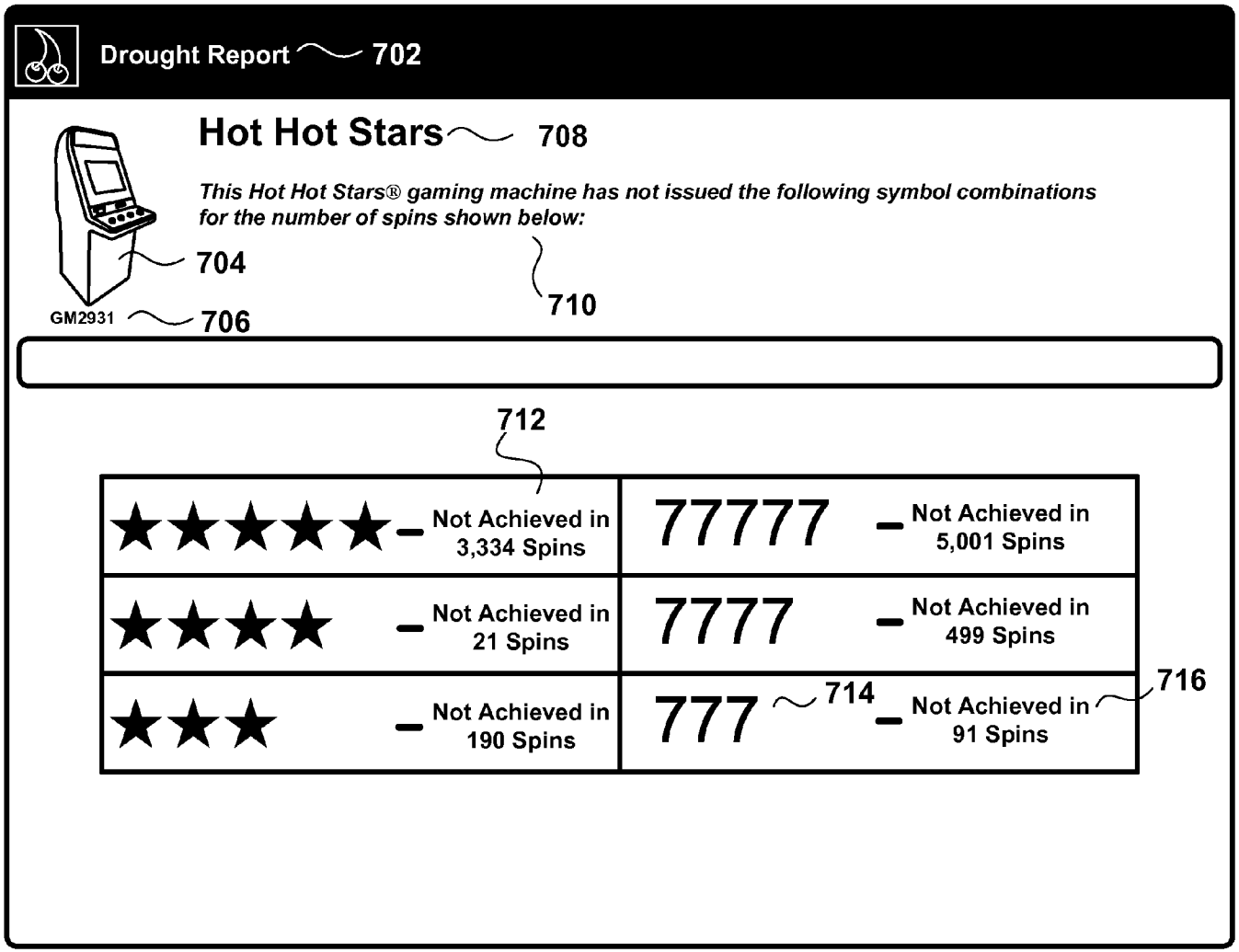
FIG. 7 depicts a second possible Historical Win Report format which displays the number of games that have been played since a particular symbol combination has occurred, according to embodiments of the present invention.

FIG. 7 depicts a second possible Historical Win Report format which displays the number of games that have elapsed since a particular symbol combination has occurred, according to embodiments of the present invention. The superstitions of the casino patron tend to vary from player to player. While some players believe that a game that is paying out certain winning symbol combinations frequently is "hot" and should be played, other players think that a game in which those winning symbol combinations have not occurred over a long period of time is "due for a win" and is thus attractive to play. The depicted Drought Report 702 is one possible embodiment of a report designed for this second type of player, the player who thinks a machine may be "due for a win."

The depicted report features a representation of the gaming machine 704 being disputed, as well as a unique identifier 706 for that machine, which unique identifier may be useful for later identification. The disputed game's title 708, in this case "Hot Hot Stars," may be depicted as well as some text explaining the purpose of the report and any other information 710 that the operator deems relevant.

The principal value of the report is a table demonstrating how many spins or games have occurred since key winning symbol combinations have been achieved on the machine 712. The depicted table shows, for example, that the winning symbol combination of "777" 714 has, as shown at 716, not been achieved in the last 91 spins. Given the advent of server-based gaming models in which multiple gaming titles may be played on multiple gaming machines, casino operators may configure the machines to display payouts by gaming title (i.e. show results for players playing Hot Hot Stars on any gaming machine in the casino) or by distinct combination of gaming title and gaming machine (i.e. show results for players playing Hot Hot Stars on the specific gaming machine on which the report was generated).

It should also be noted that while the depicted gaming machine shows symbol payouts for a slot machine game, Historical Win Reports could be configured to display the infrequency of specific hands being dealt in a video poker game, of specific levels or milestones being reached in a next generation casino (e.g. arcade or console-style) video game, of a specific number of trivia questions being answered correctly in a casino trivia game, of a specific number of puzzles being completed successfully in a casino puzzle game, etc.

Figure 8:
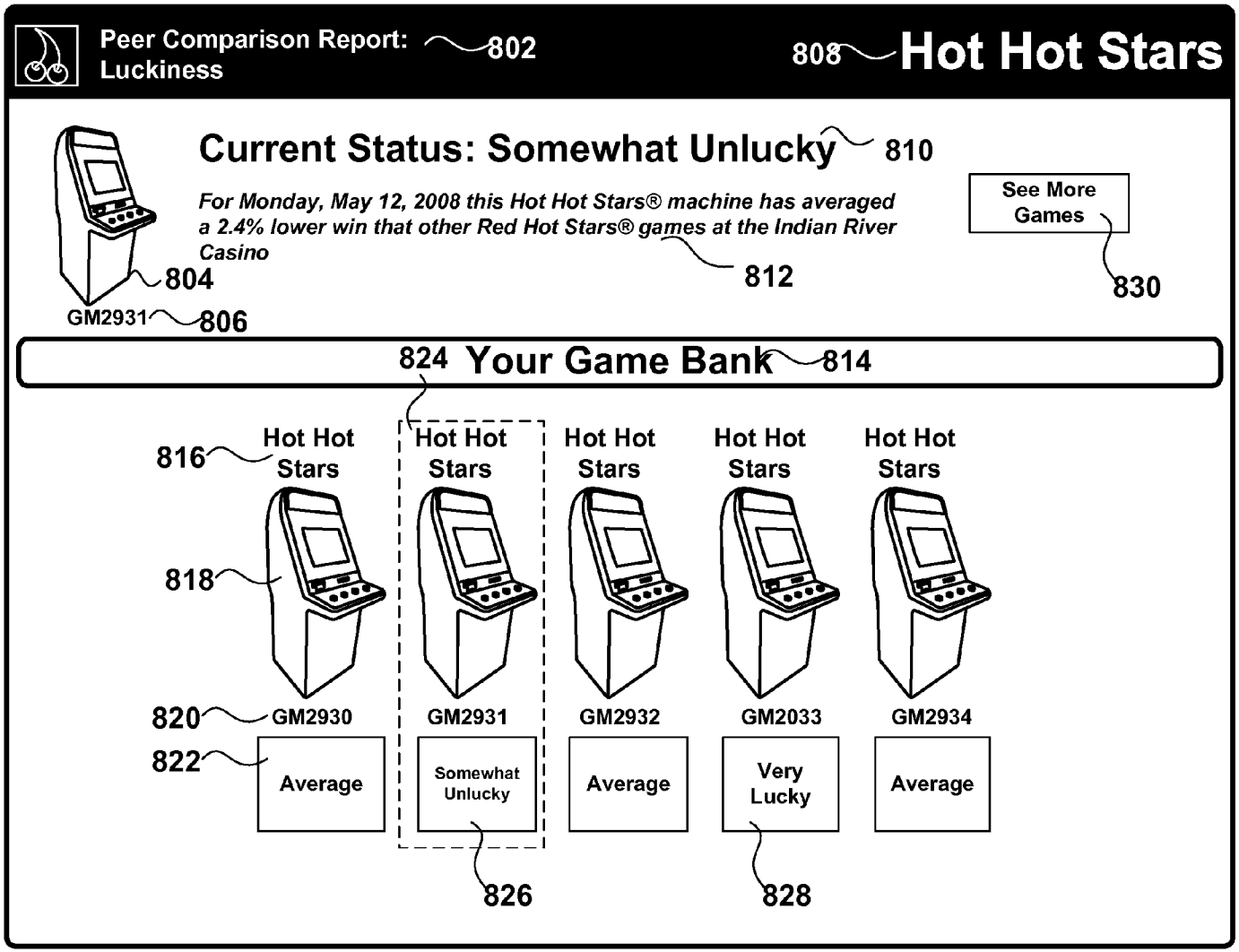
FIG. 8 depicts one possible Peer Comparison Report format displaying the "luckiness" of each gaming machine, according to embodiments of the present invention.

FIG. 8 depicts one possible format for a Peer Comparison Report, according to embodiments of the present invention. When evaluating the fairness or attractiveness of a game, players are more likely to think in terms of how "lucky" the machine is than about that machine's specific mathematical expectation or RTP. The Peer Comparison Report 802 is designed to display to the player how a machine's actual return compares to its expected return using terms to which the player can relate. A player who hasn't won on a machine for some time may actually experience some relief from a confirmation that a particular machine has been "unlucky." Players are also less likely to feel cheated when the machine delivers this degree of transparency.

The player also has the ability to use this report to see which machines have been lucky over the short term. This feature is likely to be of value to the game operator as it may cause an unlucky player who was considering quitting to continue playing on a machine that has been lucky. The game operator knows, of course, that the past performance of the machine has no bearing on its future operation or expected return to player percentage.

Like the Historical Win Report depicted in FIG. 6, the Peer Comparison Report 802 may feature a representation of the gaming machine being disputed 804 as well as a unique identifier 806 for that machine, which may be used for later identification. The game's title 808, in this case "Hot Hot Stars," may be depicted as well as the game's status 810 (in terms the player can understand, e.g., how lucky the game has been) and some text providing the player more specifics on how lucky or unlucky the machine has been, on which date or dates the report covers, and for which casino 812 the report is being generated.

The depicted Peer Comparison Report also provides information about other gaming machines in the disputed machine's bank of games 814. Such information may include, for example, each game's title 816, a visual representation 818 of each game, a unique game identifier 820 for each game, and the current status 822 of each game. The game in dispute may be highlighted as suggested at 824 so its position in the game bank relative to the other games is apparent and the game in dispute's status 826 may be repeated next to the status of the other games.

In many cases, players will intuitively seek out the game with the most favorable status, in this case Hot Hot Stars GM2033 with a status of "Very Lucky" 828. Casino operators may fear that this natural instinct would cause competition among players for the luckiest machines or may discourage play on machines that had been previously unlucky. In practice, however, server-based gaming models of the future will allow for many distinct gaming machine/software combinations and, as a result, many "lucky" games. For example, the hypothetical player who has generated Peer Comparison Report 802 may seek out GM2033 since, for Hot Hot Stars, it has been lucky. However, the player playing a different gaming title next to him—for example the hypothetical game "Hot Hot Horseshoes"—may generate a report showing that for, Hot Hot Horseshoes, GM2931 is "Very Lucky." When these reports are configured to display data for distinct gaming machine/game software combinations, machines will be lucky for some games and unlucky for others. And, of course, this data will be constantly changing.

Furthermore, operators may intelligently adjust the parameters in these reports to stimulate play. For example, operators may wish to display only reports tabulated over smaller time frames (thirty minutes, for example, or an hour) that show the performance of all game titles on a given gaming machine. By shortening in the timeframe in which these reports are tabulating data, more machines are likely to be "hot" or "lucky" (negative expectation games like slot machines or video poker machines are more unfavorable to players over longer durations than they are over shorter durations).

Game operators may also wish to allow players to view the status of games outside of the bank in which they are playing. A "See More Games" button 830 may be provided to allow players to view other physical gaming machines on the casino floor, other gaming titles, or both.

In should be noted that the mathematics used to determine a game's status may be handled in a variety of ways at the operator's discretion. A game's status may be calculated relative to a game's peers or it may be calculated relative to a baseline such as, for example, winning or non-winning. If the game's status is calculated relative to the winning/non-winning baseline, then only games that have paid out more than they have taken in over a measured time frame may be reported to players as "mildly lucky," "lucky," "very lucky," etc. If, however, a game's status is calculated relative to its peers, a game that has taken more funds from players than it has paid out may still be labeled on the "lucky" end of the lucky/unlucky spectrum if it has taken less funds than its peers. According to an embodiment of the present inventions, a winning/non-winning baseline may be employed, as it is believed that dispute resolution methods that are more intuitive to the player and more transparent are superior. However, the manner in which the math is handled in these cases is ultimately up to the game operator.

Figure 9:
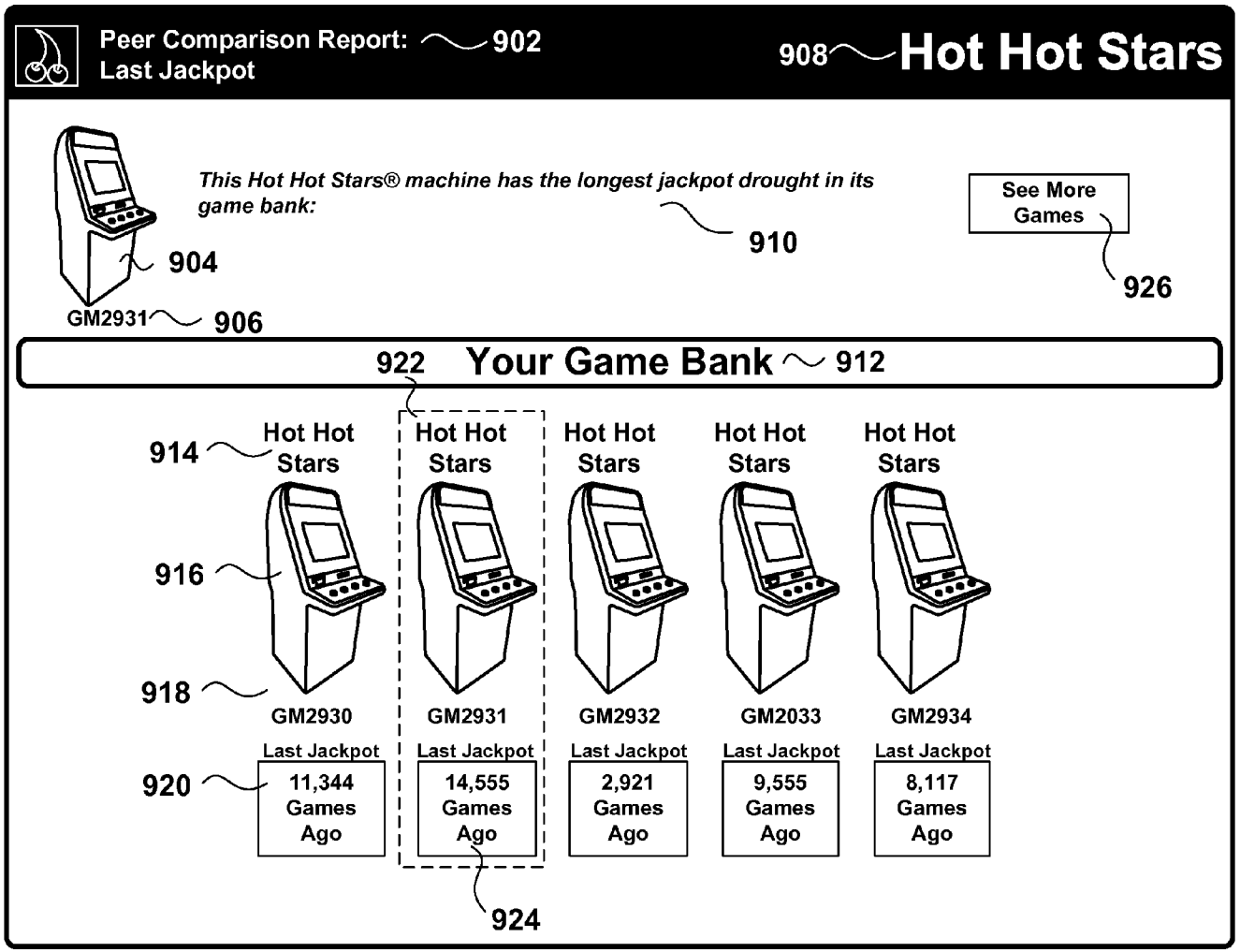
FIG. 9 depicts a second possible Peer Comparison Report format displaying how many games have been played since each gaming machine has paid a jackpot, according to embodiments of the present invention.

FIG. 9 depicts a second possible Peer Comparison Report format displaying how many games have been played since each gaming machine has paid a jackpot, according to embodiments of the present invention. Some players believe that a gaming machine that has not issued a jackpot over a long period of time is a good candidate for play since it must be "due" to pay out a jackpot. The casino operator may cater to this form of player superstition by making a report of this information available such as the depicted Last Jackpot Report 902 which is designed to display to the player how a machine's jackpot history compares to the jackpot history of other machines in the casino.

Like the Historical Win Report depicted in FIG. 6, the Last Jackpot Report 902 may feature a representation of the gaming machine being disputed 904 as well as a unique identifier 906 for that machine, which may be used for later identification. The game's title 908, in this case "Hot Hot Stars," may be depicted as well as some text providing the player more specifics on what the report displays 910.

The depicted Last Jackpot Report may provide information about other gaming machines in the disputed machine's bank of games 912 (as depicted in FIG. 9) or in multiple banks of games. Such information may include, for example, each game's title 914, a visual representation 916 of each game, a unique game identifier 918 for each game, and how many games have occurred on each gaming machine since the last jackpot was paid 920. The game in dispute may be highlighted as suggested at 922 so its position in the game bank relative to the other games is apparent and the game in dispute's status 924 may be repeated next to the status of the other games.

Players who believe that games that have not paid out jackpots over a longer timetable are "due for a win" will seek out the game with the longest jackpot drought, in this case Hot Hot Stars GM2931 that has not paid out a jackpot in 14,555 games 924. In this example, GM2931 is the machine on which the player is currently playing which, in practice, may convince the player to continue his gaming session.

Game operators may also wish to allow players to view the status of games outside of the bank in which they are playing. A "See More Games" button 926 may be provided to allow players to view other physical gaming machines on the casino floor, other gaming titles, or both.

It should also be noted that while FIG. 9 depicts a Last Jackpot report that displays the number of games that have been played since a jackpot was issued, reports that use other metrics are possible, such as a report that depicts how much time has elapsed since a jackpot was issued. Further still, reports may display more than one set of jackpot metrics side by side, such as a report that displays both how many games have been played since that last jackpot on each machine and how much time has elapsed.

Figure 10:
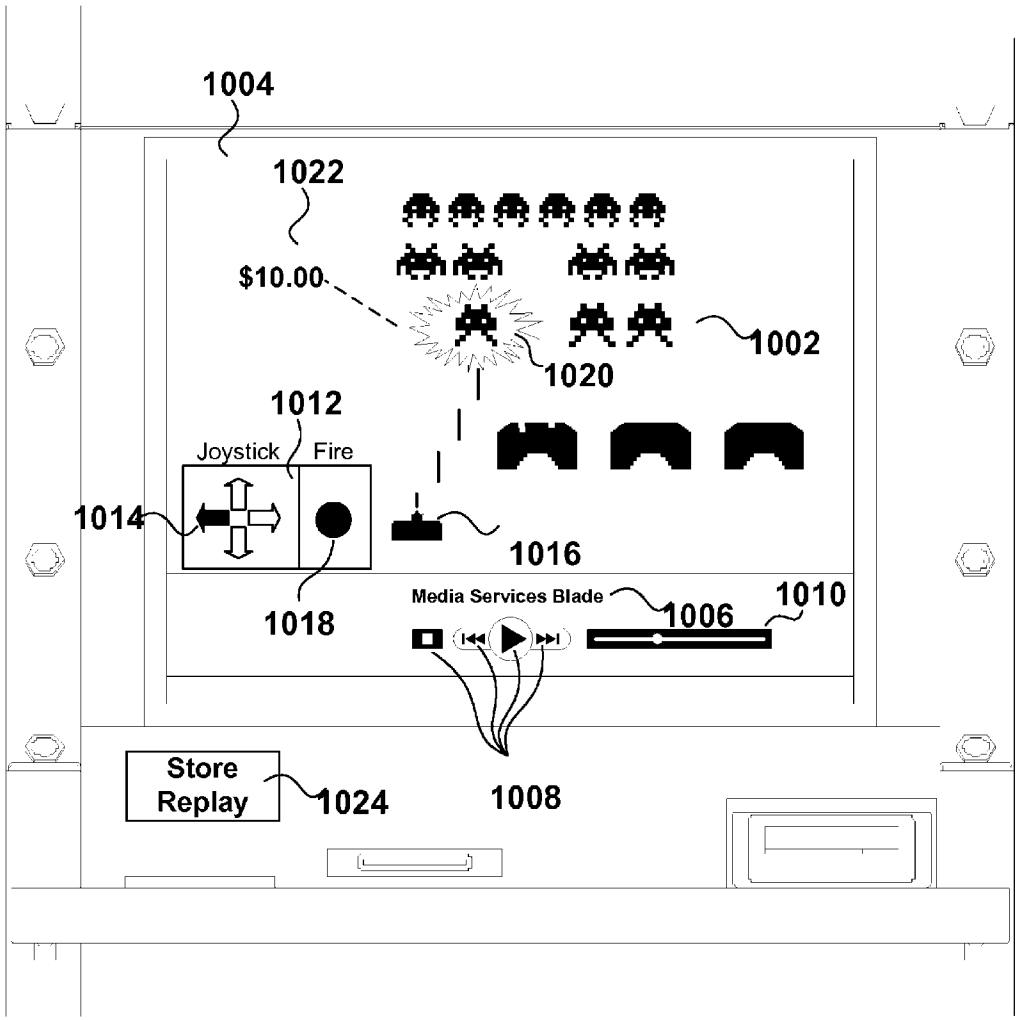
FIG. 10 demonstrates how patron disputes on next generation games may be resolved via game instant replays according to embodiments of the present invention.

FIG. 10 demonstrates how patron disputes on next generation games may be resolved via game instant replays, according to embodiments of the present invention. Instant replays of traditional games such as slot machines are captured within this PDRM to provide additional forensic evidence for patron disputes such as jackpot non-payment disputes. Instant replays of next generation casino games such as skill-based console style games are also captured and may be used to demonstrate the fairness of previously played games.

The depicted gaming machine is running a next generation casino game based on the arcade classic Space Invaders® 1002 on its primary gaming screen 1004. As is disclosed in commonly assigned and co-pending application Ser. No. 11/277,026, filed Mar. 20, 2006, which application is hereby incorporated herein by reference in its entirety, a media services blade 1006 may appear on the gaming screen featuring touchscreen commands to allow the player to play back a previously stored game, fast forward or rewind it, pause it, etc., as shown at reference numeral 1008 (the replay controls may take on the traditional media player paradigm such as is shown at 1008 or may use other paradigms such as the slider depicted at 1010). Alternatively, commands that allow the player to play back the replay, fast forward it, rewind it, etc., may be made available to the player in a bladeless interface.

As the game replay unfolds, a player input panel 1012 may appear onscreen to display the player's input at any given moment within the game. The Space Invaders® themed game that is depicted features two key player inputs, a joystick and a fire button. As a result, the depicted player input panel displays a representation of those devices onscreen as well as an indication of how they are being used at any given time. For example, the depicted joystick has its left turn arrow highlighted in black as shown at 1014. This indicates that at the moment the replay is being captured, the player was pressing his joystick left and therefore moving his onscreen cannon 1016 left. This leftmost movement is also supported by the trail of fire exiting the cannon. The fire button on the player input panel is also highlighted 1018, indicating that the player was pressing the fire button at the moment captured in the replay. This fact is also reinforced by the fire exiting the cannon.

The player input panel may be useful in showing the player the correlation between his or her input and how a game unfolds. It may also rule out disputes in which a player claims to have performed an action in the game that is not supported by the replay. The player input panel may appear in an unused portion of the gaming screen or may make use of transparency so as not to compromise the player's full view of the gaming screen.

It may be noted that the bullets (or fire) exiting the player's cannon 1016 have reached an enemy alien and caused collision 1020. The instant replay feature within the disclosed PDRM may also allow the player to see the results of his interactions as they relate to the game's payout. Because the Space Invaders game in this example is configured to award the player a cash payout during certain key in game events, the collision 1020 has earned the player $10.00 which is shown to the player onscreen at 1022. In other next generation casino gaming paradigms, the player may earn points for key in game events that are later converted into currency based on a reward table. In such instances the data displayed next to the collision would reflect points earned instead of a cash amount earned.

Because gaming machines in the disclosed PDRM are configured to store large amounts of replay data, a management system must be employed to allow both players and operators to efficiently recall relevant moments within larger game replays. In some embodiments of the inventions described herein, replays may be tagged when the player presses a button on the machine, in this case labeled as a "STORE REPLAY" button 1024 located on the gaming cabinet. This action will attach tags to one or more segments within the replay which may be accessed later and conveniently toggled through using forward/backwards buttons such as are shown at 1008. It should be noted that the large volume of replay data necessary to support the disclosed PDRM may be stored using several distinct strategies. One strategy involves storing only the key game events associated to a replay and then reconstructing or rending them into a video when requested. This first strategy is very efficient since it does not require an entire replay to be retained but carries the disadvantage of requiring modifications to existing games to support it. A second strategy involves storing the complete actual video. This second strategy has the advantage of requiring no modification to existing games but has the disadvantage of taking up a lot of memory.

It should also be noted that the complete replay data stored by the disclosed PDRM may have additional value to the game operator and game designer past dispute resolution. Focus groups have been notoriously ineffective in predicting the habits and preferences of gamblers since players who gamble in a laboratory environment or with pretend funds or funds that have been given to them for the purposes of experiment do not tend to behave in consistent ways with players who gamble with their own money in an actual casino. If used correctly, the data captured by the disclosed PDRM will be more valuable than observing a focus group as the data will represent actual live play. By analyzing the moments in which players add money to games, launch disputes, quit, etc., operators and game developers will be able to better understand what players like and don't like and create more attractive games.

Figure 11:
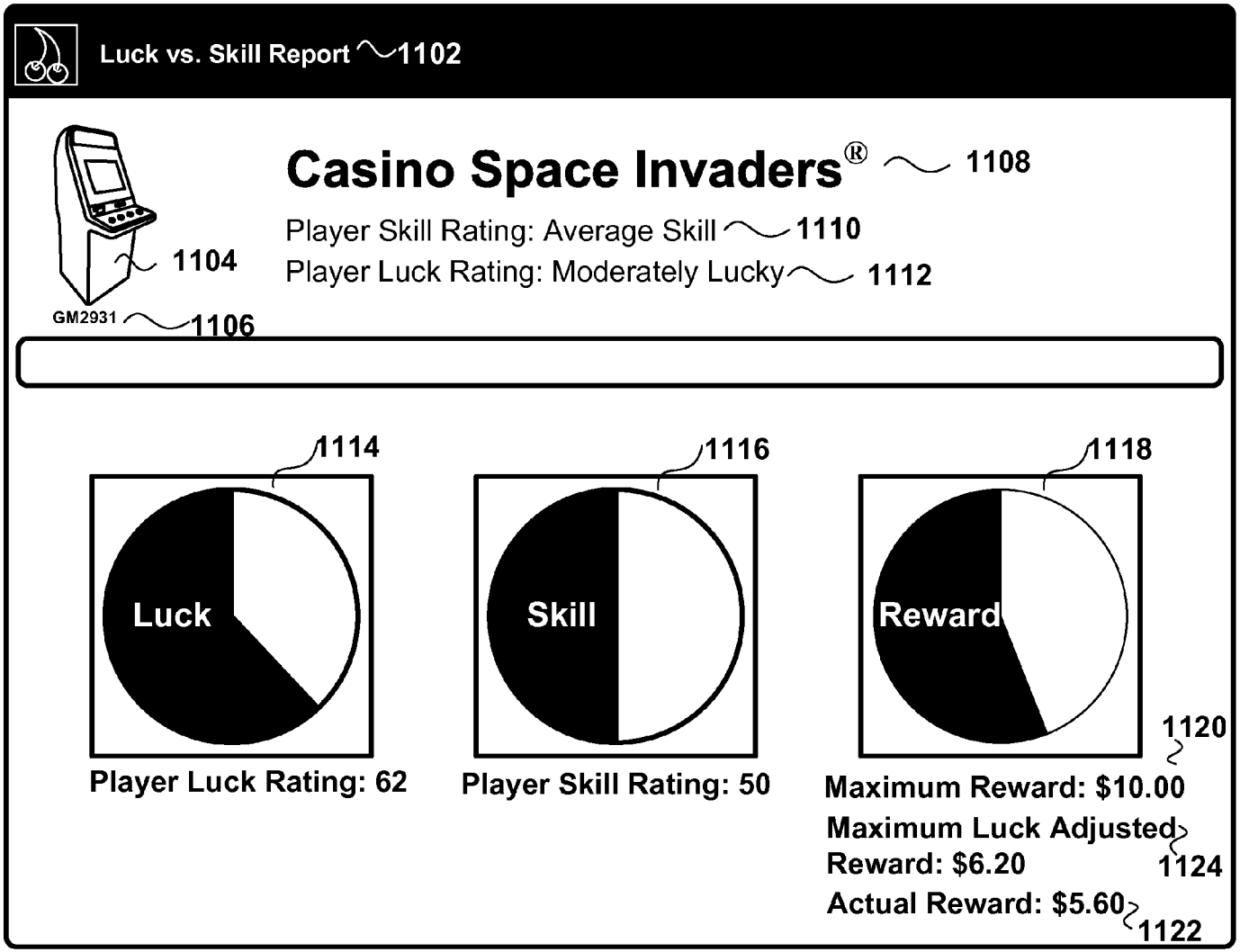
FIG. 11 depicts one possible Luck vs. Skill Report format, according to embodiments of the present invention.

FIG. 11 depicts one possible Luck vs. Skill Report format, according to embodiments of the present invention. Next generation casino gaming models and particularly console style games will increase the correlation between a player's skill and a player's rewards. Whereas the player's results in a legacy slot machine are determined completely at random, the player's results in many next generation games will be determined by a combination of randomness and the player's measured skill (broadly defined, "skill" may include, for example, the player's manual dexterity, alertness, mental acuity, strategic thinking and any other player characteristic). This added layer of complexity may prove difficult for players to understand. The role of the Luck vs. Skill Report 1102 is designed to demonstrate to players how much of their reward in a given game was determined by luck and how much their reward was determined by their skill.

Like the Historical Win Report depicted in FIG. 6, the Luck vs. Skill Report may feature a representation of the gaming machine being disputed 1104, as well as a unique identifier 1106 for that machine, which may be used for later identification. The game's title 1108, in this case "Casino Space Invaders®" may be depicted as well as the players skill rating 1110 (the game's estimation of the player's skill level) and the player's luck rating 1112 (simply, how lucky the player has been).

The Player's Luck Rating Report may also be displayed in a more visual format, in this case as a pie chart 1114. The casino operator may configure the back end mathematics of the PDRM to calculate the patron's luck figure in a number of ways. In one embodiment, a patron's luck score could simply be a measure of the player's luck adjusted maximum win's percentile rank when compared with every other player's luck adjusted maximum win over a measured period of time (the player's luck adjusted maximum win may be defined as the win the player would have achieved within the game if the player demonstrated perfect skill). In this model, if the player randomly achieved a luck adjusted maximum win of $6.74 in his game and only 4% of players randomly achieved higher luck adjusted maximum wins then the player's Luck Rating would be 96, meaning the player was in the $96^{th}$ percentile of luck.

The Player's Skill Rating may also be displayed visually, in this case as a pie chart 1116. The casino operator may configure the back end mathematics of the PDRM to calculate the patron's skill figure in a number of ways. In one embodiment, a patron's skill score could simply be a measure of the player's percentage of luck adjusted maximum win achieved. For example, if the player's luck adjusted maximum win in a given game was $4.00 and the player actually earned $2.00, then the player's skill score could be assessed as 50.

Alternatively, a patron's skill score could be the percentile rank of the player's percentage of luck adjusted maximum win achieved when compared with the percentile rank of every other player's percentage of luck adjusted maximum win achieved over a measured period of time. For example, if the player's luck adjusted maximum win was $4.00 and the player actually earned $2.00 but only 1% of players over the measured period of time achieved greater than 50% of their luck adjusted maximum wins on the player's game, then the player's skill score could be assessed as 99.

Additionally, the player's final reward may also be displayed visually, in this case in the form of a pie chart 1118. The casino operator may configure the back end mathematics of the PDRM to display the patron's visual reward display in a number of ways. In the displayed embodiment, the operator has configured the pie chart to show what percentage of the player's theoretical maximum reward (which assumes perfect luck and perfect skill) the player has actually achieved (since the player's theoretical maximum win in the displayed game is $10.00, 1120 and the player's actual reward was $5.60, 1122, the player has earned 56% of his possible reward). Alternatively, the operator could display a visual representation of what percentage of the player's luck adjusted reward 1124 the player achieved. This second figure would lead to higher reward scores; in the given example the player earned $5.60 of a possible luck adjusted win of $6.20, meaning the player earned 90% of his possible win.

It should be noted that the chief benefit of the Luck vs. Skill report to the player are the easy-to-read pie charts demonstrating the relative luck or skill that has occurred in a given game. While the back end math used to calculate these ratings can be somewhat complicated, few players will concern themselves with the manner in which the numbers were derived, although the formulas used could certainly be included in the PDRM tool's help menus.

It should also be noted that the depicted interface shows the player's Luck vs. Skill balance for the last game played. If desired, operators could configure games to allow players to view their historical games by providing them with a mechanism to view and select past games played by the title of the game played, the time the game was played, the financial result of the game, and/or a unique game identifier for each game played. In this model, reports could be generated to show how a player's luck and skill have changed over time. It is to be understood that the Luck vs. Skill Report 1102 of FIG.

11 is but one illustrative and exemplary manner of providing the player with this information. Those of skill in this art will undoubtedly develop many more formats presenting such information to the players, and all such formats are deemed to fall within the purview of the present invention.

Figure 12:
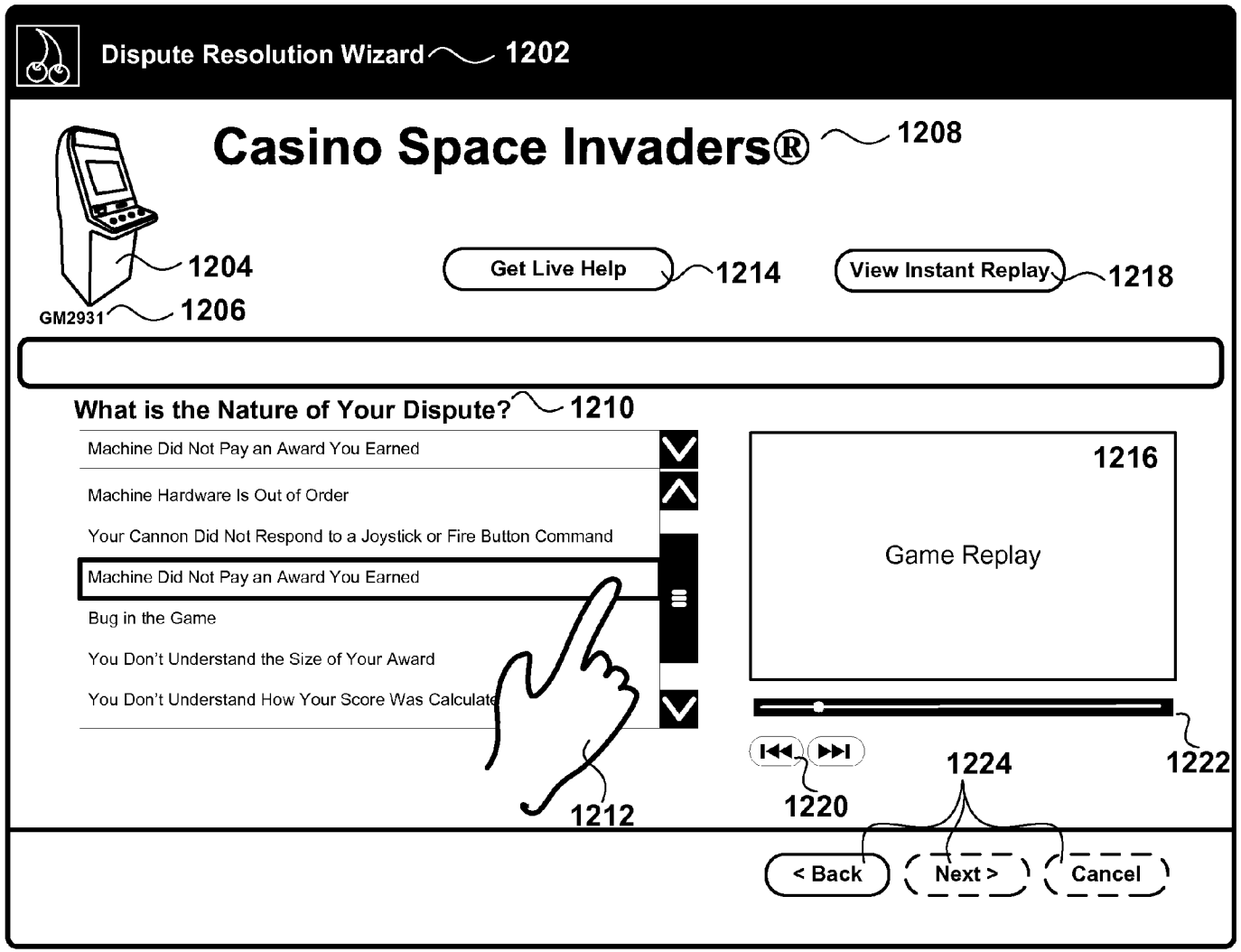
FIG. 12 depicts one possible screen within a Patron Dispute Resolution Wizard, according to embodiments of the present invention.

FIG. 12 depicts one possible screen within a Patron Dispute Resolution Wizard. In an effort to further automate the patron dispute process, operators may configure games to allow patrons to research and resolve their own disputes using a step-by-step tool that will lead them to the relevant instant replays and reports most likely to address their concerns. The depicted Patron Dispute Resolution Wizard 1202 features a representation of the disputed gaming machine 1204 as well as a unique gaming machine identifier 1206 which may be used for later identification. The wizard may also list the title of the game being disputed 1208 as well as additional information about the game according to the operator's discretion.

The significant functions of the wizard may include: a) to determine the nature of the patron's dispute 1210, which may be accomplished (for example) by allowing the patron to pick from a list of possible disputes in an onscreen menu 1212; and b) to provide the patron with tools designed to resolve his specific issue. If the patron's dispute is not included in the list of choices, a button 1214 may be made available that the patron may press to get live help. This help may take the form of a slot attendant or slot manager being dispatched to the gaming machine or it may take other forms. For example, remote help centers may be set up to provide the player with a virtual attendant, a particularly attractive option for operators who offer with a relatively small number of games and/or are situated in remote locations (common scenarios in gas stations, convenience stores, supermarkets, etc.). In these cases, two possible communication methods between the player and the virtual attendant include a touchscreen keyboard appearing onscreen or a microphone and the game's speaker being used to facilitate conversation. Other mechanisms for enabling the patron to state their dispute may be provided within the context of the present invention, the embodiments disclosed herein not being limited to pull-down menus or live help buttons.

As the patron answers questions designed to diagnose his or her problem, relevant replays or reports may be presented to resolve his or her concerns, as shown at 1216. In addition, the patron may be given the opportunity to view game replays at any time, as shown at 1218. In the displayed embodiment of the invention disclosed herein, the player may make use of standard forward and backwards keys 1220 to toggle back and forth between previously tagged replays and may make use of a slider device 1222 to fast forward, rewind, or pause a replay. The patron may also use onscreen buttons to navigate the wizard menus moving forward and backwards or cancelling a dispute as desired 1224.

In the event that a patron is not able to resolve his or her dispute independently, a slot technician or manager may be alerted to address the problem. The data entered by the patron will assist the alerted casino staff in assisting the patron in a more timely fashion than would have been possible in the absence of that information.

The automated dispute resolution method presented in FIG. 12 not only grants operators the ability to resolve patron disputes more efficiently, it also gives operators and game designers the ability to better understand and eliminate the root cause underlying disputes. By studying data related to recurrent disputes, the game operators may chose to eliminate games from their menus that are frequently disputed or game designers may make necessary changes to segments of games that often trigger disputes.

In addition, just as merchants have been known to assign ratings to customers so that they may target their marketing towards customers who they rate as attractive and discourage the business of customers who they rate as unattractive (customers who complain too much, return too much merchandise, etc.), casino operators may tie the dispute patterns of players to their player card numbers and rate them accordingly. For example, players who launch no disputes may receive coupons and attractive offers in the mail and players who launch many may receive no such incentives or promotions, or receive fewer of them.

What is claimed is:

1. A method, comprising:

enabling a player to play a regulated game on a regulated gaming machine;

receiving, by the regulated gaming machine and via a first player interaction with the regulated gaming machine, an indication that the player wishes to initiate a dispute in the regulated game, and responsive to the indication of the initiated dispute received via the first player interaction, enabling an on-demand player-initiated dispute resolution mode in which the regulated gaming machine displays, on a display thereof, a playback of at least a portion of the played regulated game, and selectively generating and displaying historical information regarding an operation of at least one of the regulated game and the regulated gaming machine, wherein the dispute resolution mode includes displaying a wizard that enables, through at least one further player interaction that is in addition to the first player interaction, an identification of a nature of the initiated dispute and a selection of the historical information to provide to the player, in a step-by-step format.

2. The method of claim 1, further including a step of receiving, via a second player interaction, an indication that the player's dispute remains unresolved.

3. The method of claim 2 wherein, responsive to the received second player interaction, the method further includes a step of summoning live help to attempt to resolve the player's dispute.

4. The method of claim 1, wherein the historical information displaying step is carried out such that the historical information includes at least one of an indication of an amount of luck experienced by the player during game play of the regulated game and an amount of skill exhibited by the player during game play of the regulated game.

5. The method of claim 1, wherein the playback displaying step includes a step of displaying a visual indication of player input as the provided playback unfolds.

6. The method of claim 5, wherein the visual indication of player input includes at least one of joystick movement and buttons pressed.

7. The method of claim 1, wherein the playback displaying step includes a step of providing player controls configured to enable the player to at least one of pause, step, fast forward and rewind the playback.

8. The method of claim 1, wherein the playback displaying step is carried out by storing key events during game play and thereafter reconstructing game play using the stored key events.

9. The method of claim 1, wherein the playback displaying step is carried out by recording game play and playing the recorded game play on demand.

10. The method of claim 1, wherein the playback providing displaying step includes enabling the player to tag relevant moments during the playback.

11. The method of claim 1, wherein the historical information displaying step is carried out with the historical information detailing an historical operation of at least one of:

the regulated game played on the regulated gaming machine, and a plurality of regulated games having been played on the regulated gaming machine.

12. The method of claim 1, wherein the historical information displaying step is carried out with the historical information providing how frequently wins have been achieved on the regulated gaming machine.

13. The method of claim 1, wherein the historical information displaying step is carried out with the historical information providing a payback frequency of the regulated gaming machine as compared to other regulated gaming machines playing the regulated game.

14. The method of claim 1, wherein the playback and/or historical information displaying step is carried out such that the playback and historical information are provided to the player upon request.

15. The method of claim 1, wherein the historical information displaying step is carried out with the historical information providing an indication of a role that both luck and player skill played in determining an outcome of the regulated game.

16. The method of claim 1, further including a step of recording and storing every game played over a selectable time interval.

17. The method of claim 1, further including a step of providing the player who has caused a dispute to be initiated an ability to cause the playback to be stored for later access and retrieval.

18. The method of claim 1, wherein the historical information displaying step is carried out with the historical information including historical win information that provides a frequency with which different symbol combinations, hands or events have historically occurred on at least one of the regulated game and the regulated gaming machine.

19. The method of claim 1, wherein the historical information displaying step is carried out with the historical information including historical win information that provides a number of games that have elapsed since a selected symbol combination, hand or event has occurred.

20. The method of claim 1, wherein the historical information displaying step is carried out with the historical information including peer comparison information that provides an indication of how lucky the regulated gaming machine has been, the indication of how lucky the regulated gaming machine has been being related to an actual Return-To-Player (RTP) of at least the regulated game on at least the regulated gaming machine.

21. The method of claim 1, wherein the historical information displaying step is carried out with the historical information including how many games have been played since at least one of the regulated game and the regulated gaming machine has paid a jackpot.

22. The method of claim 1, wherein the historical information displaying step is carried out with the historical information including luck and skill information that provides the player with an indication of a manner in which an outcome of the regulated game was influenced by randomness and by a measured skill of the player.

23. A regulated gaming machine, comprising:

a regulated game configured to run on the regulated gaming machine;

at least one display;

a button configured to enable the player to initiate a dispute, wherein the regulated gaming machine is configured to, on demand and responsive to a player pressing the button and initiating a dispute, display and enable the player to view, on the at least one display, a playback of at least a portion of the played regulated game, and to selectively generate and display, to the player, historical information regarding an operation of at least one of the regulated game and the regulated gaming machine, wherein the gaming machine is configured to, upon the player pressing the button, to cause a wizard to be displayed on the at least one display, the wizard being configured to enable an identification of a nature of the initiated dispute and a selection of the historical information to generate and provide to the player, in a step-by-step format.

24. The regulated gaming machine of claim 11, wherein the regulated gaming machine is further configured to issue, upon receipt of input from the player, an indication that the player's dispute remains unresolved.

25. The regulated gaming machine of claim 12, further including a button configured to summon live help to attempt to resolve the player's dispute.

26. The regulated gaming machine of claim 11, wherein the regulated gaming machine is configured such that the historical information includes at least one of an indication of an amount of luck experienced by the player during game play of the regulated game and an amount of skill exhibited by the player during game play of the regulated game.

27. The regulated gaming machine of claim 11, wherein the regulated gaming machine is configured such that the playback displayed on the at least one display provides a visual indication of player input as the provided playback unfolds.

28. The regulated gaming machine of claim 27, wherein the visual indication of player input includes at least one of joystick movement and buttons pressed.

29. The regulated gaming machine of claim 11, wherein the playback includes player controls configured to enable the player to at least one of pause, step, fast forward and rewind the playback.

30. The regulated gaming machine of claim 11, wherein the regulated gaming machine is configured such that the playback is generated by storing key events during game play and thereafter reconstructing game play using the stored key events.

31. The regulated gaming machine of claim 11, wherein the gaming machine is configured such that the playback is generated by recording game play and thereafter playing back the recorded game play.

32. The regulated gaming machine of claim 11, wherein the regulated gaming machine is configured to enable the player to tag relevant moments during the playback.

33. The regulated gaming machine of claim 11, wherein the regulated gaming machine is configured such that the historical information includes information regarding an historical operation of at least one of:

the regulated game played on the regulated gaming machine, and a plurality of regulated games having been played on the regulated gaming machine.

34. The regulated gaming machine of claim 11, wherein the regulated gaming machine is configured such that the historical information includes how frequently wins have been achieved on the regulated gaming machine.

35. The regulated gaming machine of claim 11, wherein the regulated gaming machine is configured such that the historical information includes a payback frequency of the regulated gaming machine as compared to other regulated gaming machines playing the regulated game.

36. The regulated gaming machine of claim 11, wherein the regulated gaming machine is configured such that at least one of the historical information and playback is displayed to the player on the at least one display upon request.

37. The regulated gaming machine of claim 11, wherein the regulated gaming machine is configured such that the historical information displayed provides an indication of a role that both luck and player skill played in determining an outcome of the regulated game.

38. The regulated gaming machine of claim 11, wherein the regulated gaming machine is configured to record and store every game played over a selectable time interval.

39. The regulated gaming machine of claim 11, wherein the regulated gaming machine is configured to enable the player who has caused a dispute to be initiated to cause the playback to be stored for later access and retrieval.

40. The regulated gaming machine of claim 11, wherein the regulated gaming machine is configured such that the historical information includes historical win information that provides a frequency with which different symbol combinations, hands or events have historically occurred on the regulated gaming machine.

41. The regulated gaming machine of claim 11, wherein the regulated gaming machine is configured such that the historical information includes historical win information that provides a number of games that have elapsed since a selected symbol combination, hand or event has occurred.

42. The regulated gaming machine of claim 11, wherein the regulated gaming machine is configured such that the historical information includes peer comparison information that provides an indication of how lucky the regulated gaming machine has been, the indication of how lucky the regulated gaming machine has been being related to an actual Return-To-Player (RTP) of at least the regulated game on at least the regulated gaming machine.

43. The regulated gaming machine of claim 11, wherein the regulated gaming machine is configured such that the historical information includes how many games have been played since at least one of the regulated game and the regulated gaming machine has paid a jackpot.

44. The regulated gaming machine of claim 11, wherein the regulated gaming machine is configured such that the historical information includes luck and skill information that provides the player with an indication of a manner in which an outcome of the regulated game was influenced by randomness and by a measured skill of the player.

* * * * *